US005862771A

United States Patent [19]

Lange et al.

[11] Patent Number: 5,862,771

[45] Date of Patent: Jan. 26, 1999

[54] DEVICE FOR HANDLING AN ELONGATED FLEXIBLE ELEMENT

[75] Inventors: Espen Lange, Oslo; Dag Aavitsland, Stabekk, both of Norway

[73] Assignee: Kvaerner Engineering A.S., Lysaker, Norway

[21] Appl. No.: 894,434

[22] PCT Filed: Feb. 21, 1996

[86] PCT No.: PCT/NO96/00041

§ 371 Date: Aug. 20, 1997

§ 102(e) Date: Aug. 20, 1997

[87] PCT Pub. No.: WO96/26862

PCT Pub. Date: Sep. 6, 1996

[30] Foreign Application Priority Data

Feb. 28, 1995 [NO] Norway ..... 950776

[51] Int. Cl.[6] ..... B63B 21/24

[52] U.S. Cl. ..... 114/293

[58] Field of Search ..... 114/230, 293; 405/165

[56] References Cited

U.S. PATENT DOCUMENTS 5,170,737 12/1992 Poldervaart ..... 114/293
5,178,087 1/1993 O'nion et al. ..... 114/293

*Primary Examiner*—Jesus D. Sotelo
*Attorney, Agent, or Firm*—Young & Thompson

[57] ABSTRACT

Device aboard floating craft for tightening/slackening of an elongated flexible element (13) such as a mooring cable that extends from a body of water up to the device (11, 12) is rotatably mounted about the longitudinal axis of the flexible element (13) directed towards the device (11,12).

4 Claims, 2 Drawing Sheets

12
11
10
2
15
13
9
4
1
6
7
5
14
8
13
3

DEVICE FOR HANDLING AN ELONGATED FLEXIBLE ELEMENT

The invention relates to a device aboard a floater for tightening/slackening an elongated flexible element, such as a mooring cable, which extends from a body of water up to the device. The invention has been developed particularly in connection with a problem encountered in the mooring of a floater at sea, where a number of mooring cables are laid out, extending from a respective anchor on the seabed up to a winch on the floater. Such mooring cables may be of considerable length and, as a result thereof, undesirable twists may easily occur in the cables during the mooring process. If such a twist occurs in the mooring cable it must be eliminated, which is a difficult and time-consuming process with traditional equipment. The object of the invention is to facilitate the removal of undesired twists or winding of a mooring cable in a relatively simple and inexpensive manner.

According to the invention, this is achieved by making arrangements so that said device, generally a winch, is rotatably mounted about the longitudinal axis of the elongated flexible element directed toward the device.

By being rotatably mounted in said manner, the device can, when necessary, be rotated about the longitudinal axis of the element and will, during this rotational movement, bring along with it the elongated flexible element, thus rotating it in a direction that will remove any unwanted twist in the element.

In the case of, for example, semisubmersible platforms where legs or columns protrude through the surface of the water from a submerged float up to a platform deck, the mooring winches will be positioned on top of a respective column, and the mooring cables will then extend from the lower part of the column and vertically up along the column to the respective mooring winch. In such and similar cases said longitudinal axis of the element will extend principally in a vertical direction, and, correspondingly, the device for tightening/slackening the element will be rotatably mounted about an axis having a principally vertical extension.

The device according to the invention can be used at many locations, but is particularly advantageous for use aboard a floater that is constructed with a vertical shaft having a rotating tower, a so-called turret, mounted therein, this being the part that is anchored to the seabed, the floater being permitted to rotate on the sea round the turret.

Figure 1:
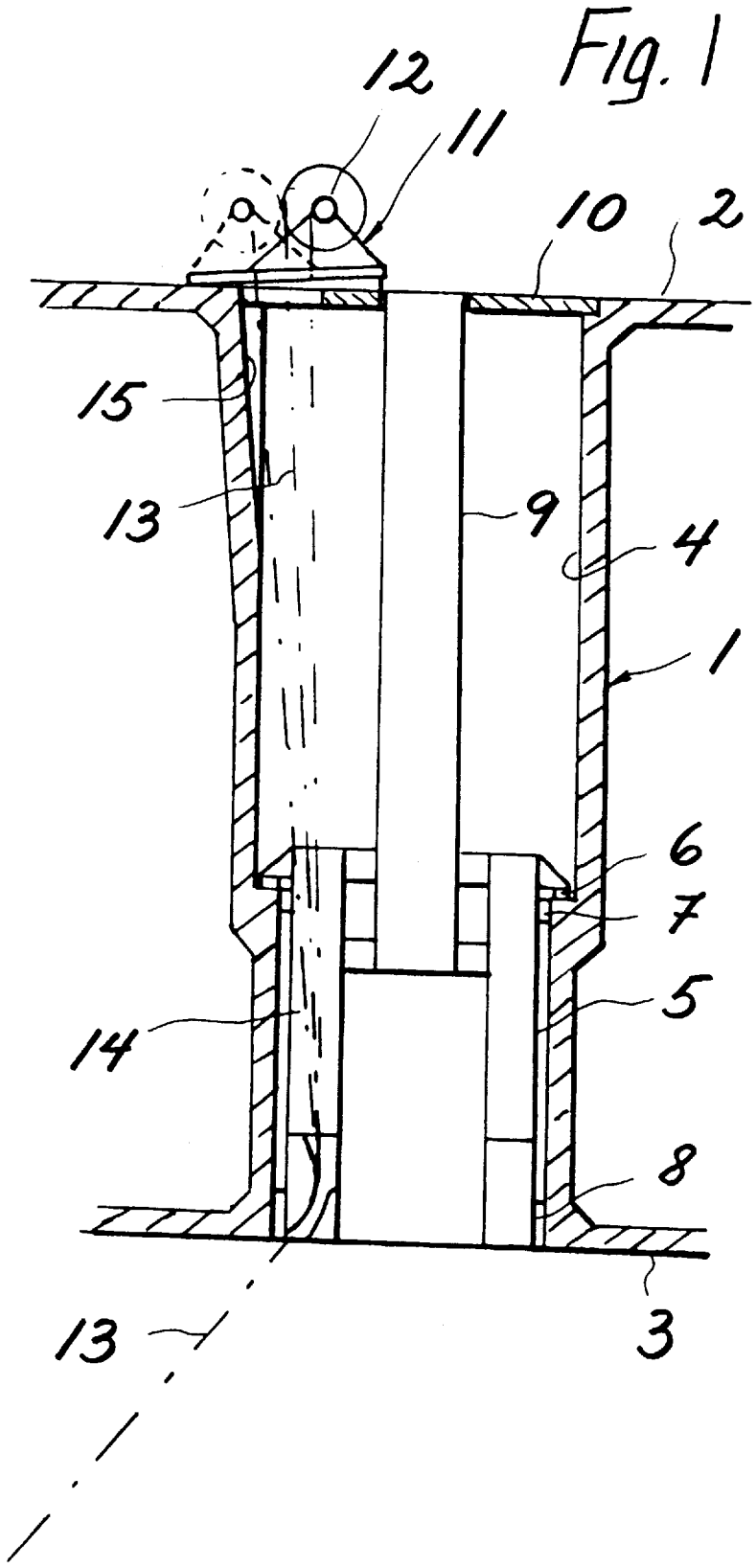
Figure 2:
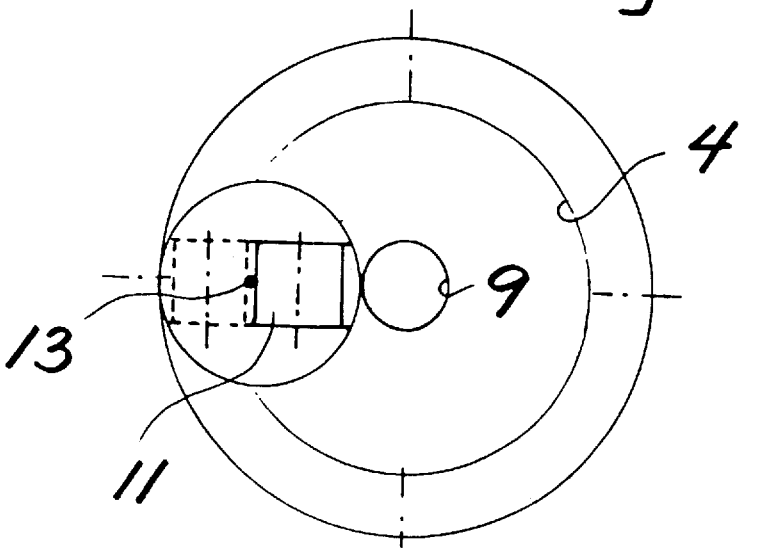

The invention shall now be further explained with reference to the drawings, wherein FIG. 1 is a schematic section through a vessel constructed with a vertical shaft wherein there is disposed a rotating part to be anchored to the seabed, and FIG. 2 is a schematic plan view of the shaft area.

In FIG. 1 there is shown a section through a vessel 1, which has a deck 2 and a bottom 3.

The vessel 1 has a vertical, throughgoing shaft 4 extending from the bottom 3 up to the deck 2. In the shaft 4 there is positioned a rotating part 5 which is rotatably mounted in the shaft 5 about its vertical axis by means of suitable bearings 6, 7 and 8.

The rotating part 5 has a central, tubular extension 9 continuing further up through the shaft 5 to the level of the deck 2. The shaft 4 is closed with a top part 10 at the level of the deck 2. This top part can be removed or opened in convenient locations for providing access to the shaft 5 and the rotating part 5.

On the deck 2 and the top 10 there is positioned a mooring winch 11 the drum of which is indicated by the reference numeral 12. A mooring cable 13 may be wound on and off the drum 12. As illustrated, this mooring cable 13 extends from the winch 11 down through the shaft 4 and through a vertical guide track 14 in the rotating part 5, and further down into the ocean.

The mooring cable 13 is manipulated by means of the winch 11, i.e., it will be hauled in and tightened to the degree desired by means of the winch 11 when a mooring position is being provided. When the desired tension of the mooring cable 13 is achieved, the mooring cable will be locked to the rotating part 5 in a manner that is not further illustrated. For this purpose there may be used many devices known per se, capable of gripping the mooring cable and holding it in a fixed position. Optionally, a chain stopper may be used, the mooring cable 13 then comprising a shorter length of chain to be used in the area of the lower section of the mooring part 5 and some distance down into the ocean. After the mooring cable 13 has been locked, the winch 11 can be disconnected.

Many times during the laying of the mooring cable 13 some undesired twist will unavoidably occur in the cable. In order to eliminate such a twist the winch 11 has been positioned in a rotatable manner. This is to say that the winch 11 is rotatably mounted on the deck 2, respectively on the top 10, about an axis extending principally in a vertical direction and coinciding with the mooring cable 13. With dotted lines there is indicated a position of the winch 11 in which it has been rotated 180°. The rotational mounting of the winch 11 can be carried out in a manner known per se, for example by means of a turntable.

The mooring cable 13 may occupy different vertical positions in the shaft 4, dependent upon the winding diameter of the drum 12, and this is suggested with dot-and-dash lines in the shaft.

In this connection there is shown an optionally enclosed area 15 at the top of the shaft 4 for providing space for the mooring cable 13.

As shown in FIG. 2, the whole winch, together with the pertaining turntable, can be moved round the circle, so that one and the same winch 11 may be used sequentially for handling successive mooring cables.

The invention is not limited to use aboard a vessel having a vertical shaft and a part rotatably mounted therein, but can advantageously also be used, for example, in connection with semisubmersible floaters where the mooring cables extend upward along columns to winches mounted at the top of the columns.

Neither is the invention limited to the use of winches of the classical type shown in the drawings, since it can be carried out by means of any device suitable for tightening/slackening the mooring cable, provided that arrangements are made so that the interaction between the device and the mooring cable is such that a rotation of the device about the longitudinal axis of the mooring cable also brings about a turn of the mooring cable.

We claim:

1. A device aboard a floater for tightening/slackening an elongated flexible element (13), such as a mooring cable that extends from a body of water up to the device (11, 12), characterized in that the device (11, 12) is rotatably mounted about the longitudinal axis of the flexible element (13) directed toward the device (11, 12).

2. A device according to claim 1, characterized in that the device (11, 12) is rotatably mounted about the longitudinal axis of an element extending principally in the vertical direction.

3. A device according to claim 1, characterized in that the device (11, 12) is adapted for the tightening/slackening of an elongated flexible element (13) that extends up into the floater (1) through a vertical shaft (4) in the floater.

4. A device according to claim 3, characterized in that the device (11, 12) is movable along and within the circumference of the vertical shaft (4).

* * * * *